United States Patent [19]

Bessler

[11] 4,098,035

[45] Jul. 4, 1978

[54] INFLATABLE STORM WINDOW

[76] Inventor: Edward W. Bessler, 8 Rosemont Dr., Crestview Hills, Ky. 41017

[21] Appl. No.: 816,488

[22] Filed: Jul. 18, 1977

[51] Int. Cl.[2] ..... E04B 1/34

[52] U.S. Cl. ..... 52/2; 52/202

[58] Field of Search ..... 52/2, 171, 202, 203, 52/406; 49/477, 62

[56] References Cited

U.S. PATENT DOCUMENTS

| | | | |
|---|---|---|---|
| 2,825,941 | 3/1958 | Lux et al. | 49/477 X |
| 3,911,630 | 10/1975 | Nally | 52/202 X |
| 3,918,512 | 11/1975 | Kuneman | 49/477 |
| 4,040,210 | 8/1977 | Land | 52/171 X |

*Primary Examiner*—Ernest R. Purser
*Assistant Examiner*—Carl D. Friedman
*Attorney, Agent, or Firm*—Robert J. McNair, Jr.

[57] ABSTRACT

An inflatable storm window is disclosed which is adapted to be positioned within a window frame to both provide insulation and prevent air leakage around the regular window sash. The inflatable storm window comprises a continuous hollow outer portion of tubular cross section formed from a pliable and expandable plastic. A transparent sheet of film is peripherally attached to the inner edge of the continuous hollow outer portion. Installation in the window frame is accomplished by inflating the hollow outer portion through a valve contained in the tubular sidewall.

4 Claims, 9 Drawing Figures

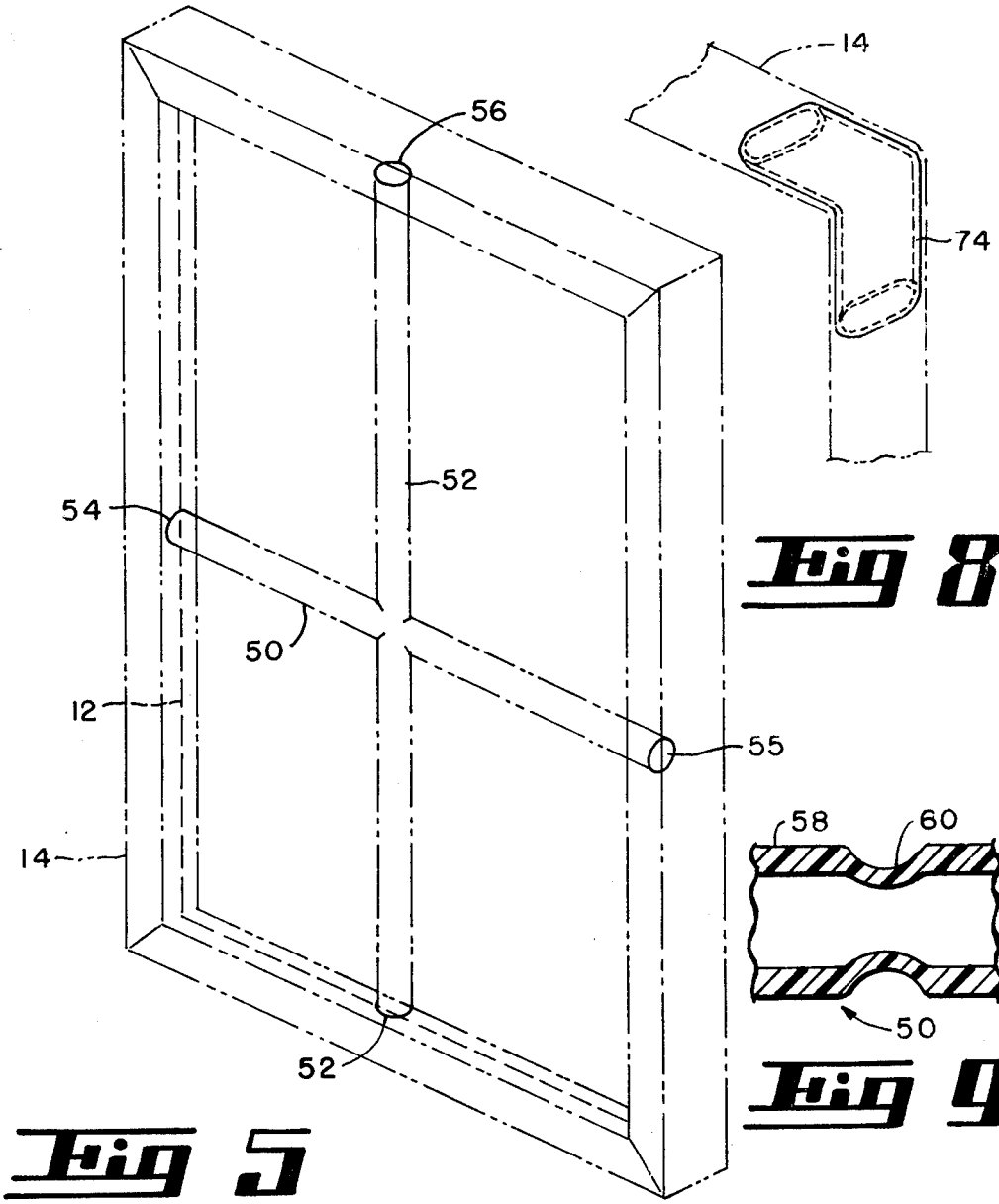
Fig 5
Fig 8
Fig 9
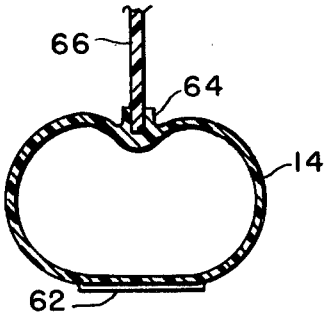
Fig 6
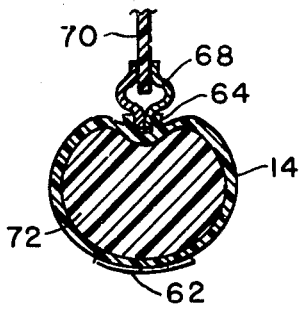
Fig 7

INFLATABLE STORM WINDOW

BACKGROUND OF THE INVENTION

This invention relates to an inflatable storm window that can be packaged in a rolled up or folded state. On partial inflation, the window will balloon out to the desired rectangular shape. At this point it can be fitted into the window opening, covering the existing sash and forming an airtight barrier with the window frame. The inflatable window is made from a flexible material which readily adjusts in size to the variations in tolerances experienced in the building trade. For example, applicant has found that there will be at least a half inch of size variation in the horizontal and vertical wall opening dimensions associated with a window having a nominal 3 foot by 3 foot frame size.

A search of the related art reveals that in the U.S. Pat. No. 3,918,512 to Kuneman, there is disclosed an inflatable window panel. Mr. Kuneman eliminates air leakage through an inner window, outer storm window combination by placing an inflatable plastic bag between the two windows. Enough pressure is added to the bag to make it firmly contact the frame periphery between sashes. Nally in U.S. Pat. No. 3,911,630 discloses a storm window comprising a rigid self supporting transparent sheet or pane having a second flexible transparent sheet overlying the first. The flexible sheet is peripherally attached to the first at the sash or frame, thus providing an inflatable dead airspace between the two sheets for preventing heat loss through the window opening. Lux, et al., in U.S. Pat. No. 2,825,941 discloses an inflatable closure sealer, formed somewhat as a tube, that serves as a sealing strip between a rigid window pane and the surrounding window frame.

None of the references cited above disclose the features of my invention. I first observed that a ring shaped tubular device, for example, a bicycle inner tube would expand in diameter on being inflated. Expansion of the tube is such that both the inner and outer diameter increases. Thereafter, I discovered that a transparent flexible sheet fused to the innermost circumference of a bicycle innertube will be stretched taut on inflation of the tube. Very few windows are round. However, I next discovered that a rectangular tubular structure having a sheet of transparent flexible film fuzed to its innermost edge would expand to fill a rectangular opening. This discovery makes it possible to inexpensively fabricate a storm window sash which forms a barrier that virtually eliminates the air leakage through and around a conventional window sash glazed with glass. The inflatable window also cuts convective heat losses by a large amount.

SUMMARY OF THE INVENTION

The storm window is made from a flexible material which tends to expand on inflation. Typically, it will consist of an encircling outer portion which has a generally tubular cross section. Within this outer tubular portion is a transparent pliable membrane which becomes taut when the assembly is inflated. In its uninflated state the storm window assembly may be collapsed and folded into a compact configuration. Partial inflation causes the storm window to assume its final shape. However, at this stage, it is dimensionally smaller, by perhaps a span width of an inch, than the window into which the storm window is to be positioned. On further inflation, the periphery of the storm window expands to provide a positive airtight seal between the window frame and the outer periphery of the inflatable storm window.

The central transparent portion, in the preferred embodiment consists of two spaced membranes. Communication ports between the outer tubular portion and the space between the spaced membranes allows pressurization of the cavity formed therebetween. This pressurization helps both to maintain a taut status of the membranes and to form an insulated dead air space similar to those found in double glazed glass window sashes.

Upon being inflated, the storm window is held in place in the window frame by the air pressure acting on the sides and top and bottom portions of the tubular sections in a manner which keeps them in a tight gripping relation with the frame. Inflation is by means of a valve placed in the sidewall of the tubular portion. A pump or pressurized cannister of conventional design is used for accomplishing inflation.

My invention provides a storm window which can be fabricated inexpensively from various polymeric resinous materials such as polyethylene and the like. The inflatable storm window is easy to install and readily adapts to the dimensional tolerances found in buildings which have been standing for many years.

DESCRIPTION OF THE DRAWINGS

FIG. 5 is a perspective view of a storm window having inflatable cross-support tubes in addition to the transparent membranes.

FIG. 6 shows a cross section of the tubular member used in an alternate version of the window.

FIG. 7 shows a cross section of a tubular member inflated with a foam-in-place plastic.

FIG. 8 shows a corner reinforcement for use with either the FIG. 1 or FIG. 5 storm windows.

FIG. 9 shows a cross section of one of the FIG. 5 cross-support tubes.

DESCRIPTION OF PREFERRED EMBODIMENT

Figure 1:
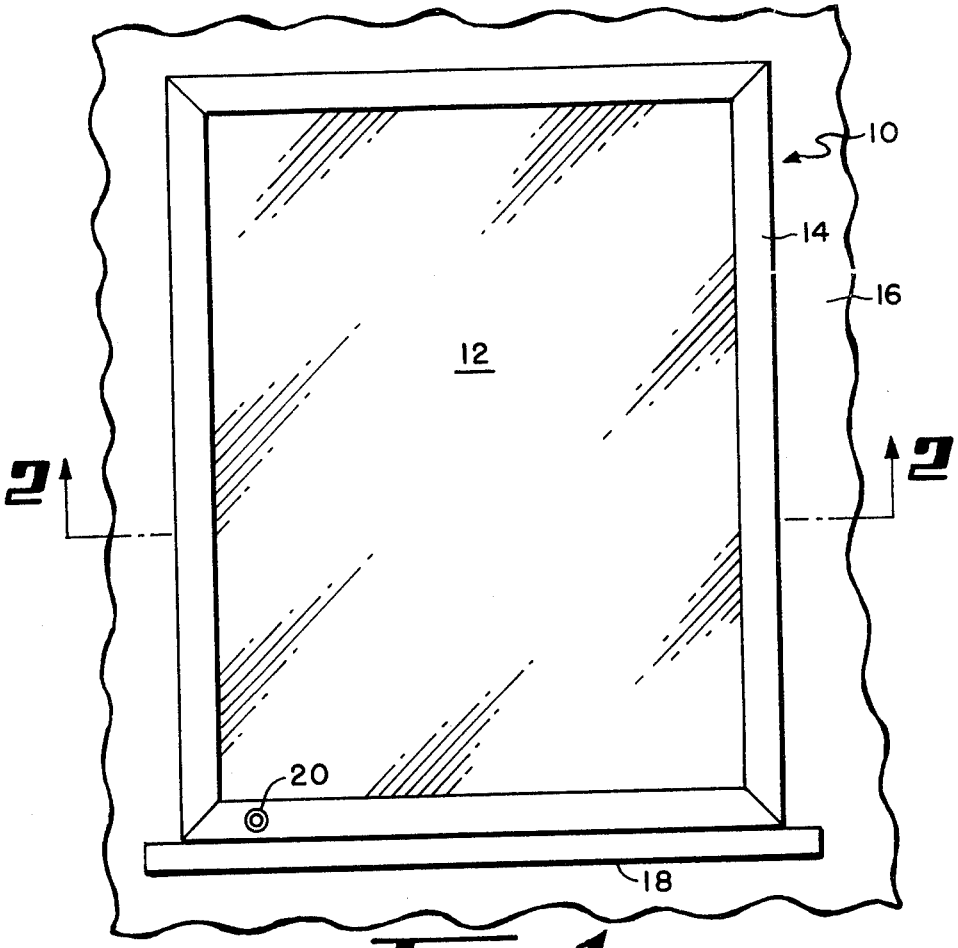
FIG. 1 is a frontal view of my storm window arrangement as seen from inside the house.

FIG. 1 shows storm window 10 comprised of flexible transparent sheet 12 and an encircling outer portion 14 of generally tubular cross section. Transparent sheet 12 is secured to encircling outer portion 14 by conventional means such as cementing or heat sealing. Window 10 is shown positioned within the window opening of building wall 16 and sill 18. Inflation of the storm window is accomplished by means of valve 20.

Figure 2:
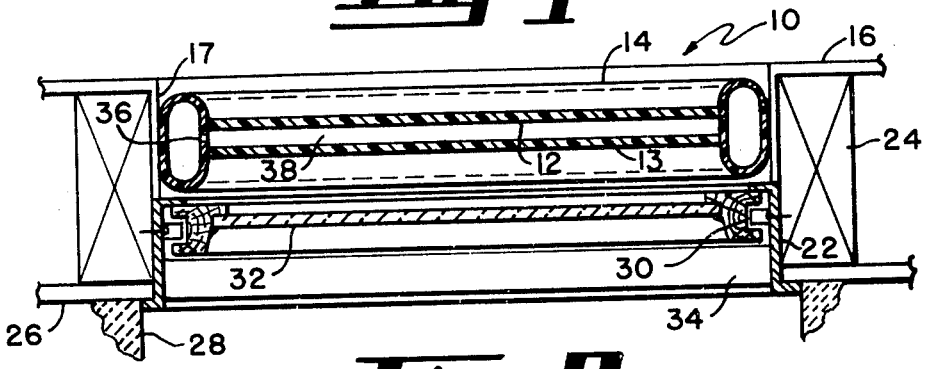
FIG. 2 is a cross sectional view of the storm window in position in front of a double hung window sash, the cross section being along lines 2—2 of FIG. 1.

FIG. 2 shows a cross sectional view of the installed storm window taken along line 2—2 of the FIG. 1 presentation. In FIG. 2, outer portion 14 of storm window 10 is seen to be pressing against window opening sidewall 17. Sidewall 17 is shown as extending from window frame 22 to inside wall 16 of the building. In the FIG. 2 implementation frame 22 is intended as typifying aluminum frame window construction where frame member 22 is secured by nails or screws to stud member 24. Exterior insulation board 26 is faced with brick wall 28. Inside wall member 16 and sidewall 17 can typically be of plaster, plasterboard, or wood paneling. Window frame 22 contains lower window sash 30 which is glazed with glass pane 32. The bottom side of upper window sash 34 is shown as being placed outwardly of lower sash 30.

FIG. 2 shows that there is a second transparent sheet 13 placed parallel to and behind first transparent sheet 12. Injection of pressurized air into tubular outer member 14 does two things. First, the pressurized air causes outer member 14 to enlarge in cross section and expand outward so that the outer periphery of member 14 presses against window sidewall 17. Second, the pressurized air is allowed to flow into the cavity between first sheet 12 and second sheet 13. Pressurizing the space between sheets 12 and 13 both keeps the film taut thus precluding transparency destroying wrinkles and at the same time establishes an improved insulation barrier.

Figure 3:
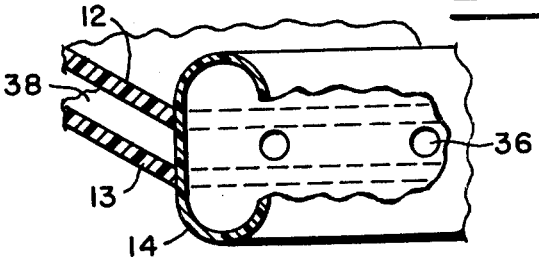
FIG. 3 is a cut-away view of the storm window of FIG. 2, showing the communicating ports between the outer tubular portion and the spaced transparent membranes.

Communication between the inside of tubular member 14 and the cavity between transparent sheets 12 and 13 is shown in FIG. 3. Ports 36 along the inward facing wall of tubular member 14 allows a gradual flow of air both into and out of central cavity 38.

Figure 4:
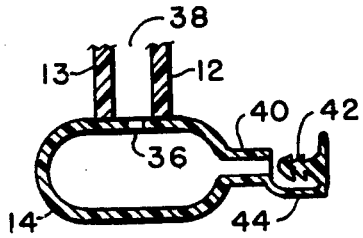
FIG. 4 shows one type of inflating valve.

FIG. 4 shows one form of valve which may be used for inflating the storm window. A short section of flexible tubing 40 is attached to the sidewall of tubular outer member 14. Attachment may be by cementing, vulcanizing or a parametric heat seal depending on the materials used. The nozzle of the pressurizing cannister (not shown) is inserted in the end of tube 40 and the storm window inflated. After inflation, the nozzle would be removed and plug 42 inserted in the end of tube 40. Plug 42 has transverse serrations on its outward extending end so that it does not slip out of tube 40 after insertion. It is usually found expedient with this type of valve to include loop 44 between plug 42 and tube 40 so that the pressure retaining plug does not get lost. In some implementations it may be desirable to use pressurizing valves of the type used in basketball bladders or bicycle inner tubes.

FIG. 5 shows a configuration of my invention which is generally similar to that shown in FIG. 1. However, there is added to the FIG. 1 configuration a pair of flexible tubular supports 50 and 52. The ends of tubular support 50 are attached to outer member 14 at junction points 54 and 55. Attachment is such that there is communication between the interior of tubular outer member 14 and the interior of tubular support 50. The same arrangement applies at junction points 56 and 57 where support 52 attaches to the inside edges of outer element 14. Inclusion of horizontal and vertical tubular support members 50 and 52 provides additional outward thrust on the midspan portions of the storm window. This results from the fact that pressurization of tubular supports 50 and 52 cause them to assume a rigid, straight position.

The reason that tubular support members tend to lengthen when pressurized is shown in FIG. 9 which is an enlarged cross sectional view of a segment of tube 50. There are a multiplicity of regularly spaced cross axis indentations along tube 50. One such indentation 60 is shown in FIG. 9. Since there is less wall thickness stock at indentation 60 than at wall section 58 in the tube, pressure on the inside of the tube tends to make the tubular member expand lengthwise. Tubing of this type can be readily obtained as a standard stock item.

The choice as to whether horizontal and vertical tubular supports are needed is somewhat a function of window size. Small windows do not require any midspan support. Large storm windows may need more than the single horizontal and vertical support shown in FIG. 5.

FIG. 6 shows in partial cross section, an alternate implementation of the storm window. There is shown a cross section of tubular outer member 14. Member 14 has on its window frame contacting edge, a strip 62 of tacky material which is firmly attached to member 14. Strip 62 can be either a gummy plastic substance that adheres to the window frame or a strip of plastic having surface gripping striations on its outermost side. Along the inward facing edge of tubular outer member 14 there is lipped groove 64. Into this groove 64 is placed a self supporting sheet 66. Self supporting sheet 66 may, for example, be made of a transparent plastic material that is approximately one eighth inch thick. Alternatively, the self support structure shown in FIG. 7 may be used.

The FIG. 7 implementation includes tubular outer member 14 having groove 64 along the inside edge. Inserted in groove 64 is metallic strip 68. Metallic strip 68 may be die formed as shown. Strip 68 will extend around the periphery of a transparent sheet 70, serving to keep sheet 70 stretched out taut as it is held between the opposing faces of metallic strip 68. Sheet 70 may be cemented in place in strip 68. Metallic strip 68 also provides a supporting structure against which the tubular outer member can exert force when pressing against the window frame.

FIG. 7 also illustrates another means for filling the outer tubular member. Instead of pressurizing the inflatable window with air, FIG. 7 shows the result achieved when a foam-in-place plastic filler 72 is used. With the FIG. 7 implementation, a permanent custom fitted storm window is achieved since the tubular outer member 14 will expand everywhere to fit the configuration of the window frame. Then, once the foam-in-place plastic has set up, the storm window assembly will permanently retain the shape originally assumed.

FIG. 8 shows a preformed right angled elbow 74 which can be inserted into the corners of tubular outer member 14 during the fabrication phase. Elbows 74 assist the inflated storm window to remain snuggly in the corners of the window frame. Elbow 74 can be fabricated from a polymeric resinous material that readily bonds to the material used in making tubular outer member 14 stock.

The illustrated embodiments of my invention have been described in considerable detail. It will be understood that modifications may be made to the cross sectional configuration of the tubular outer member and in the specific form of valve unit used to inflate the window without departing from the spirit of my invention. Also various means can be used to inflate the storm window unit.

I claim:

1. An inflatable storm window adapted for positioning within a surrounding frame structure, comprising:

a continuous hollow outer portion of tubular cross section formed from a pliable and expandable plastic, said outer portion being capable of being inflated, the outside dimensions after inflation of said hollow outer portion being dimensionally sized for sealing and retaining engagement within said frame structure;

a valve placed in the sidewall of said tubular outer portion for accomplishing inflation; and a pliable central portion comprising, two transparent spaced apart membranes, each peripherally attached to the inner edge of said outer tubular portion, said membranes, being dimensionally sized so as to become taut when said tubular outer portion is inflated;

a multiplicity of communication ports in the inward facing wall of said tubular outer portions, said ports being for the purpose of pressurizing the space formed between said membranes when said outer tubular portion is inflated; and tubular support members between said spaced apart membranes, the ends of said tubular support members being attached to the inner wall of the outer tubular member, said tubular support members including cross axis indentations at regular intervals whereby pressurization of the inside of the tubular member with respect to the outside tends to make said tubular member expand in length, thus providing additional pressure between the outer tubular portions and the window frame in the mid-span regions.

2. An inflatable storm window according to claim 1 wherein said window is fabricated from a polymeric resinous material.

3. The inflatable storm window according to claim 1 wherein the inflating valve comprises a short section of flexible tubing perpendicularly attached at one end to the sidewall of said outer tubular portion and having in its other end a removable plug, said plug having transverse serrations on its outward extending end for retaining said plug in said flexible tube.

4. The inflatable storm window according to claim 1 wherein the outermost side of said outer tubular portion includes a strip of tacky material on the surface thereof, said tacky material providing improved sealing properties between said storm window and said window frame.

* * * * *